US009730481B2

(12) United States Patent
Uresti

(10) Patent No.: US 9,730,481 B2
(45) **Date of Patent: *Aug. 15, 2017**

(54) DEVICE FOR DISPENSING ARTIFICIAL EYELASHES

(71) Applicant: Albea Services, Gennevilliers (FR)

(72) Inventor: Osvaldo Uresti, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 7 days.

This patent is subject to a terminal disclaimer.

(21) Appl. No.: 14/580,384

(22) Filed: Dec. 23, 2014

(65) Prior Publication Data

US 2015/0181968 A1 Jul. 2, 2015

(30) Foreign Application Priority Data

Dec. 31, 2013 (FR) ..... 13 63731

(51) Int. Cl.
*A41G 5/02* (2006.01)
*A41G 5/00* (2006.01)
*A45D 44/00* (2006.01)

(52) U.S. Cl.
CPC ..... *A41G 5/02* (2013.01); *A41G 5/0086* (2013.01); *A45D 44/00* (2013.01)

(58) Field of Classification Search
CPC ..... A41G 5/02; A41G 5/0086; B65H 37/005; B65H 35/06; B65H 35/002; B65H 35/10; B65H 35/26; Y10T 225/238; Y10T 225/259; A45D 44/00
USPC ..... 132/216, 201, 73; 225/46, 77, 1, 43, 57
See application file for complete search history.

(56) References Cited

U.S. PATENT DOCUMENTS 2,399,545 A * 4/1946 Davis ..... A61F 13/02 602/55
8,657,170 B2 * 2/2014 Martinez ..... A41G 5/02 132/216
9,107,461 B2 * 8/2015 Martins ..... B65D 83/0864
2010/0047301 A1 * 2/2010 Park ..... A45D 29/001 424/401
2010/0170526 A1 * 7/2010 Nguyen ..... A41G 5/02 132/201

(Continued)

FOREIGN PATENT DOCUMENTS

GB 1183011 A * 3/1970 ..... A45D 29/001
WO 2013/171232 11/2013
WO 2013/171405 11/2013

OTHER PUBLICATIONS

French Application No. 1363731, International Search Report, dated Oct. 14, 2014.

*Primary Examiner* — Robyn Doan
(74) *Attorney, Agent, or Firm* — Banner & Witcoff, Ltd.

(57) ABSTRACT

The invention relates to a device for dispensing artificial eyelashes, comprising a housing equipped with a dispensing region, a carrier to which a plurality of artificial eyelashes is fixed, a movement mechanism capable of being actuated to cause movement of the carrier in order to convey the artificial eyelashes towards the dispensing region and to allow the artificial eyelashes to exit through said dispensing region, said eyelashes being oriented transversely to an axis of extension of the carrier, at least when they are passing through said dispensing region.

12 Claims, 3 Drawing Sheets

(56) References Cited

U.S. PATENT DOCUMENTS

Figure 1:
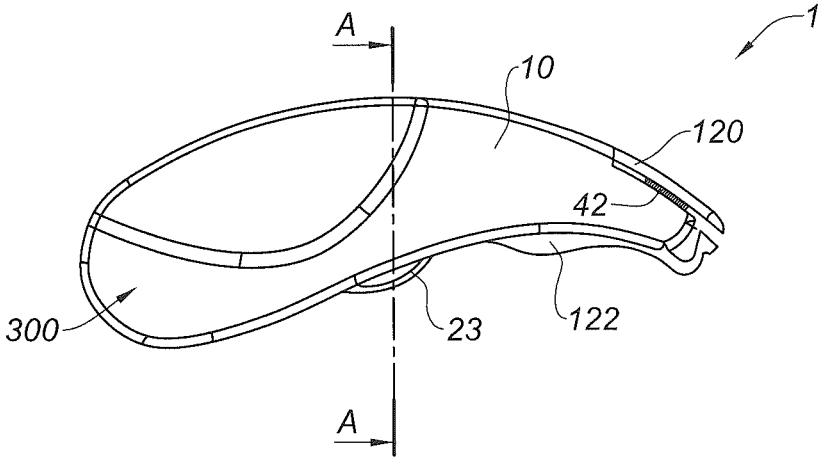

| | | | | |
|---|---|---|---|---|
| 2012/0000957 | A1* | 1/2012 | Martinez | A41G 5/02 225/57 |
| 2014/0216488 | A1* | 8/2014 | Dinh | A41G 5/02 132/53 |
| 2014/0263392 | A1* | 9/2014 | Martins | B65D 83/0864 221/71 |
| 2015/0136162 | A1* | 5/2015 | Brouillet | A45D 44/00 132/53 |

* cited by examiner

DEVICE FOR DISPENSING ARTIFICIAL EYELASHES

This application claims priority to and the benefit of French Application 1363731 filed Dec. 31, 2013. The above-identified application is incorporated by reference herein in its entirety.

The invention relates to the field of applying make-up, more particularly to the eyes, by adding artificial eyelashes to the natural eyelashes that are more commonly referred to as 'false eyelashes'.

The invention more specifically relates to a device for dispensing artificial eyelashes.

Artificial eyelashes are generally used to increase the volume, the length or the lustre of natural eyelashes, or to give the face an aesthetic and decorative feature in the same way as a piece of jewellery, for example.

Artificial eyelashes are generally sold in the form of units, each unit comprising a fringe of eyelashes and a connecting strip holding the eyelashes together at their base, the other end of the eyelashes being free. These units can be sold in pairs in conventional boxes which have only changed slightly since they were first used.

These boxes do not have any particular aesthetic or fun aspects for the consumer which may attract them to one product over another. Indeed, the companies selling these boxes can only distinguish them from other products by colour variations, and cannot give boxes for artificial eyelashes original features in terms of design or function which truly identify the brand of the eyelashes.

Furthermore, these boxes are not very practical as they only provide limited quantities of units of artificial eyelashes, typically a single pair, and this tends to increase the volume occupied by such a box as well as the price of the pair of units of eyelashes sold. These two factors tend to limit the purchase of large quantities of artificial eyelashes.

Moreover, applying units of eyelashes to the eyelids is a delicate operation. First, the user has to apply adhesive to the connecting strip. They must then apply the connecting strip, which has adhesive applied thereto, along the edge of the eyelid at the roots of the natural eyelashes.

There is therefore a need to propose housings that allow a large number of units of artificial eyelashes to be stored in a limited space.

There is also a need to propose housings for artificial eyelashes that allow artificial eyelashes to be handled easily and quickly using a gesture that is gentle on the eye and that allows the user to control the application operations, in particular when looking in a mirror.

The problem addressed by the invention is that of overcoming the above-mentioned drawbacks and proposing for this purpose a device for dispensing artificial eyelashes, comprising a housing equipped with a dispensing region, a carrier to which a plurality of artificial eyelashes is fixed, and a movement mechanism capable of being actuated to cause movement of the carrier in order to convey the artificial eyelashes towards the dispensing region and to allow the artificial eyelashes to exit through said dispensing region, said eyelashes being oriented transversely, in particular orthogonally, to an axis of extension of the carrier, at least when they are passing through said dispensing region, or all the way along said carrier.

Owing to the carrier and to its movement mechanism, the user can have a large number of eyelashes available that can be easily dispensed from the housing. In addition, the orientation of the eyelashes allows the housing to be brought closer to the eye in a transverse manner, which would be perceived as a gesture that is less aggressive compared with an application movement in the line of sight. It should also be noted that such a configuration allows the housing to be held when applying the eyelashes, making it possible for the user to look in a mirror, since the housing, while being close to the eye, is not or is only slightly in the line of sight.

The eyelashes are preferably grouped into units of eyelashes, in particular using a connecting strip.

Advantageously, said connecting strip is positioned to the side beyond said carrier, such that said carrier is not an obstacle to applying the units of eyelashes to the eyelid.

According to a preferred aspect of the invention, the eyelashes of one of said units of eyelashes are oriented in the opposite direction to the preceding and/or subsequent unit of eyelashes along the carrier.

Such a feature makes it possible to arrange first and second categories of units of eyelashes, corresponding to each of the two orientations given to said units of eyelashes, the first category allowing easier application of the eyelashes to the right eye and the second category allowing easier application of the eyelashes to the left eye, by holding the housing in the corresponding hand and using a symmetrical gesture.

Said units of eyelashes are advantageously arranged alternately in each of said orientations, in order to make up one eye and then the other with each use.

According to different embodiments, which may be taken together or separately:

- said eyelashes are curved so as to be able to fit closely to the curvature of natural eyelashes,
- each eyelash is positioned on said carrier in the region of the middle of the eyelashes in the longitudinal direction thereof,
- the carrier comprises a strip, said eyelashes being positioned on said strip,
- said strip comprises an adhesive region or a plurality of separate adhesive regions,
- the adhesive region/regions comprise(s) an adhesive coating on the carrier strip,
- each of said adhesive regions is an adhesive strip positioned along the carrier,
- said adhesive strip, of which one is provided, is located substantially along a central axis of said strip,
- said adhesive strips, of which two are provided, are located along two longitudinal edges of said strip,
- the adhesive strip/strips is/are continuous or in the form of a succession of adhesive points,
- the movement mechanism comprises a reel, which is rotatably mounted relative to the housing,
- said carrier is wound around said reel so as to be gradually unwound by the eyelashes exiting,
- said reel has a winding surface intended for receiving said eyelashes, said winding surface being provided with a concave or convex curvature that is substantially identical to the curvature of the eyelashes,
- said movement mechanism is configured so that the movement of the carrier causes said carrier to be unwound from the reel,
- the mechanism for moving the carrier comprises:
  - a spool that is rotatably mounted relative to the housing,
  - an actuation means for rotating the spool, allowing the carrier to be wound around the spool, the winding of the carrier strip around the spool causing the movement of the carrier, the housing comprises an opening and the actuating means comprises a scroll wheel which can be operated via the opening, the movement mechanism further comprises a deflecting element arranged close to the dispensing region, said units of eyelashes are the same length, taken along their connecting strip; in other words, they have substantially the same number of eyelashes, the dispensing region comprises a dispensing opening located on a side of the housing, said dispensing opening extends in parallel with said carrier, advantageously over at least the length of the longest of said units of eyelashes, the edges of the dispensing opening form tweezers together with the walls of the housing, allowing said eyelashes to be gripped and removed from the carrier, said tweezers are designed to allow the eyelashes to be held after removal, in order to make it easier to apply adhesive to the eyelashes and/or to apply said eyelashes.

The invention also proposes an assembly for applying artificial eyelashes, the assembly comprising:

at least one device according to any of the preceding claims, a bottle of an adhesive capable of applying adhesive to units of eyelashes, and a bottle of a product capable of dissolving said adhesive.

It is thus possible to provide a housing allowing a large number of units of artificial eyelashes to be stored and allowing these units to be dispensed as required. In addition, the way the user handles the device gives applying artificial eyelashes a fun aspect, the device being simple and innovative in its operation compared with the boxes that are conventionally used in this field.

Figure 2:
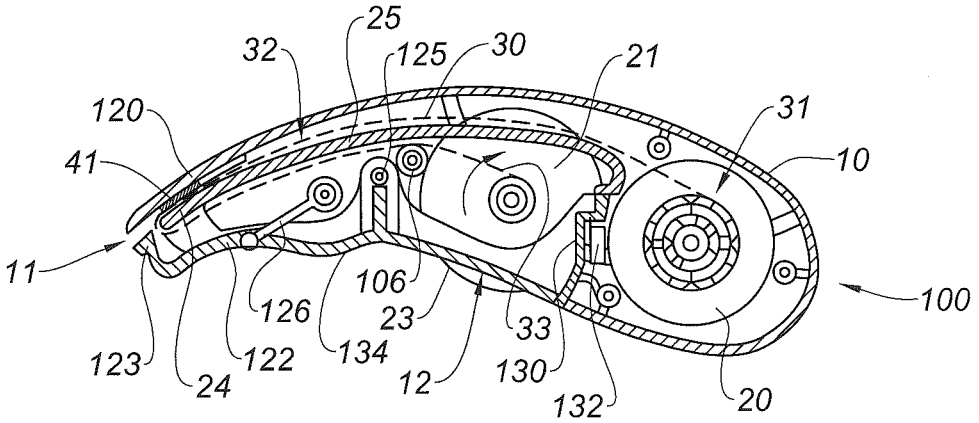
Figure 3:
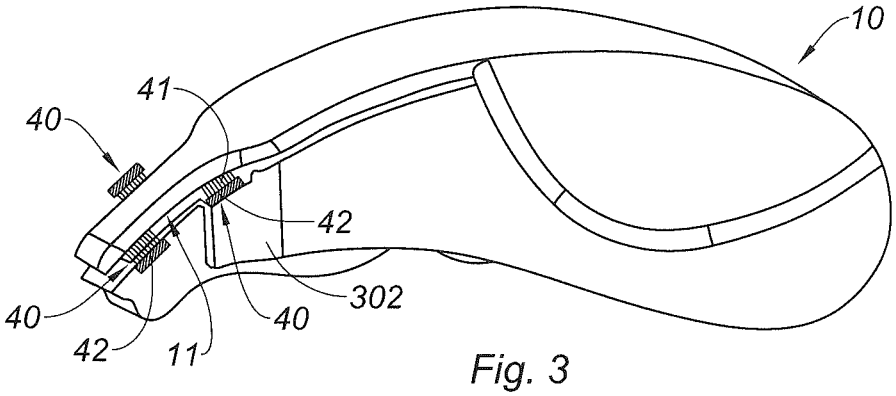
Figure 4:
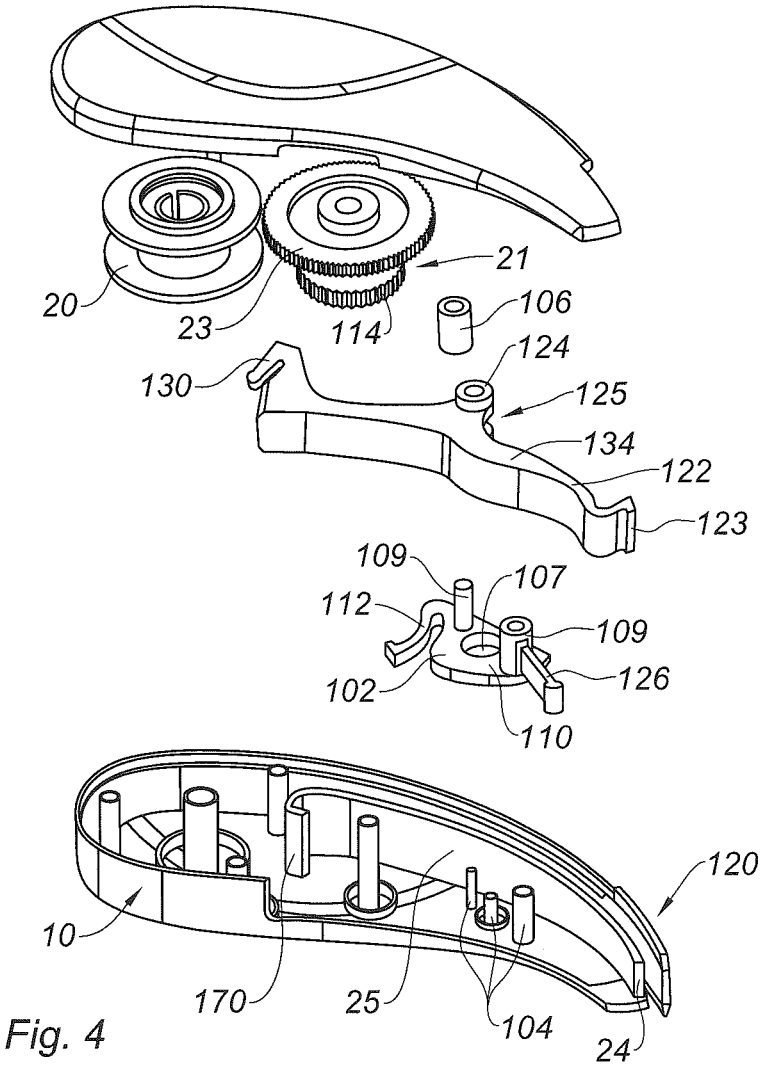
Figure 5A:
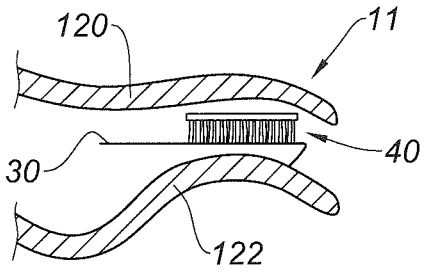
Figure 6A:
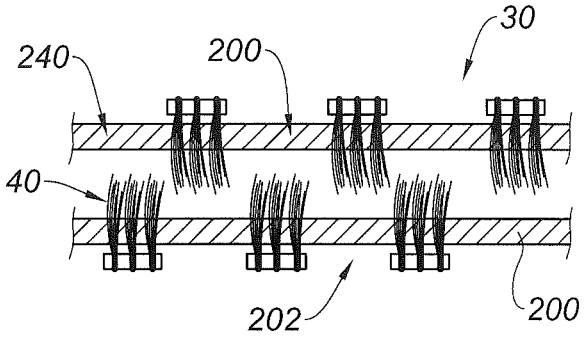
Figure 5B:
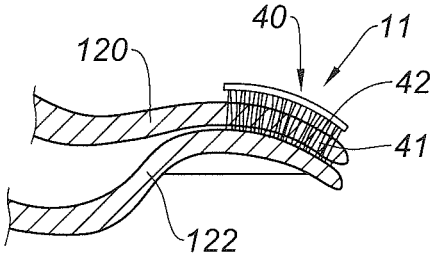
Figure 6B:
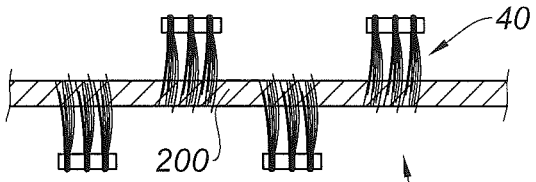
Figure 7:
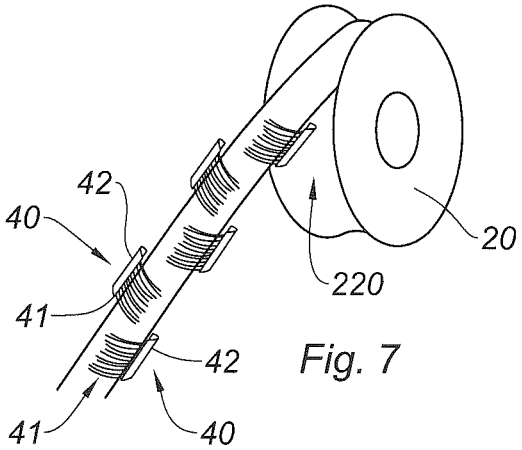

Other features, aims and advantages of the invention will become clearer from the following description, which is given purely by way of illustrative and non-limiting example and should be read with reference to the accompanying drawings, in which:

FIG. 1 is a front view of a device for dispensing artificial eyelashes according to an embodiment of the invention, FIG. 2 is a longitudinal section through the device from FIG. 1, FIG. 3 is a perspective view of the device from FIG. 1, FIG. 4 is an exploded perspective view of the device from FIG. 1, FIGS. 5*a* and 5*b* are schematic longitudinal sections through a distal end of a dispensing device according to the invention in two different configurations, FIGS. 6*a* and 6*b* are schematic plan views of two embodiments of the carrier of a dispensing device according to the invention, FIG. 7 is a schematic perspective view of the carrier and an element of the movement mechanism of a dispensing device according to the invention.

As shown in FIG. 1, the invention relates to a device for dispensing artificial eyelashes.

This device 1 comprises a housing 10, preferably made of a plastics material such as polypropylene (PP), polyethylene (PE), acrylonitrile butadiene styrene (ABS), styrene acrylonitrile (SAN) or polyethylene terephthalate (PET), polyethylene terephthalate glycol-modified (PETG), Surlyn® resin or polyoxymethylene (POM). The housing may also be made of metal, such as aluminium, Zamak, etc.

This housing 10 may be opaque, or by contrast may be transparent, so that the elements that it contains can be seen.

As shown in FIGS. 2 and 3, the housing 10 is provided with a dispensing region 11, provided in this case by an opening in the housing, through which the eyelashes 41 exit in order to be used by an individual. Said device also comprises, inside the housing 10, a carrier 30, shown by the dashed line and designed in this case in the form of a strip to which the eyelashes 41 are fixed. Still inside the housing 10, said device also comprises a movement mechanism capable of being actuated in order to cause the strip 30 to move to convey the eyelashes 41 towards the dispensing opening 11. Said device is thus configured to allow artificial eyelashes 41 to exit through the dispensing opening 11 as a result of the movement of the strip 30.

According to the invention, said eyelashes 41 are oriented transversely to an axis of extension of the carrier 30, at least when they are passing through said dispensing region 11. In this case, they are more particularly oriented orthogonally to the axis of extension of said strip 30, preferably all the way along said carrier. Such an orientation of the eyelashes allows the eyelashes to be handled in order for adhesive to be applied thereto and/or for them to be applied using a simple and intuitive gesture.

On the strip 30, the eyelashes are advantageously grouped together in the form of units 40 of eyelashes.

The fixing of the units to the strip 30 is preferably ensured by an adhesive coating on the strip, the coating having properties suitable for allowing the units 40 that are to be dispensed to be removed without damaging the eyelashes 41.

Each unit 40 of eyelashes may comprise a fringe of eyelashes 41 and a connecting strip 42. The eyelashes are interconnected at one end, preferably their base, by the connecting strip 42, the other end being free.

The artificial eyelashes 41 and the connecting strip 42 are made of synthetic fibres, typically polybutylene terephthalate (PBT), and are rigidly connected to the connecting strip 42 by any known method, for example they may be bonded to or integrally formed with the connecting strip. They may also be sewn to the connecting strip or welded thereto.

Advantageously, said connecting strip 42 is positioned to the side beyond said carrier 30. This makes it easier to apply adhesive to the eyelashes and/or to apply said eyelashes to the eyelids.

According to a preferred aspect of the invention, which can be better seen in FIG. 7, the eyelashes of one of said units 40 of eyelashes are oriented in the opposite direction to the preceding and/or subsequent unit 40 of eyelashes along the carrier. Such a change in orientation advantageously takes place for each unit 40 of eyelashes, such that said units 40 of eyelashes are alternately oriented in one direction and the other.

Such a feature allows a unit 40 of eyelashes intended for the right eye to be handled, and then for the subsequent unit 40 of eyelashes intended for the left eye (or vice versa) to be handled using symmetrical gestures with the corresponding hands. The user therefore does not have to get around the obstacle formed by the nose in at least one of the cases.

The strip 30 may have a plurality of separate adhesive regions, said regions being for example covered with an adhesive coating, the remainder of the strip not being adhesive.

As shown in FIGS. 6*a* and 6*b*, each of said adhesive regions is formed for example by an adhesive strip 200 positioned along the carrier.

In FIG. 6*a*, said adhesive strips 200, of which two are provided, are located along two longitudinal edges 202, 204 of said strip.

In FIG. 6*b*, said adhesive strip 200, of which one is provided, is located substantially along a central axis of said strip 30 of the carrier.

Said adhesive strips 200 are, for example, continuous, as in this case, or are in the form of a succession of adhesive points (this variant is not shown).

The dispensing units 40 are advantageously bonded to said adhesive regions, in the region of the middle of the eyelashes in the longitudinal direction thereof, so as to bond neither the ends of the eyelashes nor the connecting strip, the artificial eyelashes in this case having an intrinsic curvature, as natural eyelashes do. For example, if the eyelashes are 10 mm long, the units of eyelashes may have adhesive applied thereto over a strip of 5 mm that is in the centre over half the length of the eyelashes.

This has several advantages: the ends of the eyelashes are kept separate from one another so that they do not alter the look of the eyelashes once they are in place on the user's eye. Indeed, the residue of adhesive on the units of eyelashes is reduced compared with completely bonding the eyelashes, and in particular, each free end of the eyelashes is not stuck to the adjacent eyelash. The aesthetics of the units of eyelashes are therefore maintained.

Finally, since the eyelashes are held by the middle of their length on the strip, their ends protrude less than they would if the eyelashes were fixed to the strip by the other end.

In other words, there is a height H between the end of the eyelashes of a unit and the strip 30 which is reduced compared with the same height H' if the units of eyelashes were bonded to the strip 30 in the region of the connecting strip.

Consequently, the ends of the eyelashes are not in contact with a wall of the housing 10 when the eyelashes are moved in the dispenser and can therefore be freely moved in the dispenser.

The units 40 of eyelashes are preferably regularly distributed over the carrier strip 30 such that they are spaced apart by a constant interval between two consecutive units. Typically, this interval may be between 5 and 20 mm.

Typically, the eyelashes have a length L of between 8 and 15 mm, preferably equal to 10 mm.

The width of the housing may moreover advantageously be adapted such that the eyelashes do not come into contact with the sides 300 of the housing. In other words, the inner walls of said sides are spaced apart by a distance that is greater than the length of the eyelashes 41 taken together with their connecting strip 42.

As for the units 40 of eyelashes, they have a width I that depends on the number of eyelashes. They are all preferably of the same width.

The dispensing opening 11 is located for example on the lateral sides 300 of the housing. Said dispensing opening extends in particular in parallel with said strip 30 of the carrier, over at least the length of the longest of said units of eyelashes, for example over a length allowing a plurality of units of eyelashes to appear through said opening 11.

In FIGS. 1 and 2, a single unit 40 of eyelashes is shown, whereas in FIG. 3, three units 40 of eyelashes are shown. In FIGS. 1 and 3, it is noted that the eyelashes 41 project from the sides of the housing 10.

For this purpose, said housing has, for example, a reduced thickness at the end of said dispensing region 10, substantially corresponding in this case to the width of the carrier strip 30. In other words, said lateral sides have a shoulder 302 which make the distal end of the housing 10 substantially beak-shaped.

As seen in FIG. 2, the movement mechanism comprises a reel 20, which is rotatably mounted relative to the housing 10. A first longitudinal end of the carrier strip 30 is fixed to the reel, and a part 31 of the strip, to which the units of artificial eyelashes to be dispensed are fixed, is wound around the reel 20. The reel 20 is therefore positioned upstream of the dispensing opening 11, and may even form the starting point of the path of the strip.

The part 31 of the strip that is wound around the reel forms a reserve of units of eyelashes 40. More particularly, the dimensions of the device 1 may allow several metres of carrier strip 30 to be wound, for example between 0.5 and 2 metres of strip, thereby allowing between 60 and 180 units of artificial eyelashes to be stored. This allows a user to have approximately 10 to 30 days' worth of artificial eyelashes. The dispensing device 1 thus allows a considerable number of units of artificial eyelashes to be stored, unlike the conventional boxes, and indeed in a highly compact manner, owing to the strip being wound around the reel.

The reel 20 is in the form of a cylinder having a circular cross section, the cylinder being movable in rotation about its axis of revolution and having a length that is greater than or equal to the width of the carrier strip 30. This allows the carrier strip 30 to rest satisfactorily on the outer surface of the cylinder 20.

The reel may be made of the same material as the housing 10.

As can be seen particularly clearly in FIG. 7, said reel 20 may have a winding surface 220 which is intended to receive said eyelashes, said winding surface being provided with a curvature which is concave in this case and is substantially identical to the curvature of the eyelashes. In a variant, said winding surface may be convex. In this way, the eyelashes are prevented from being squashed on the reel.

If reference is again made to FIG. 2, it is noted that the mechanism for moving the carrier strip 30 further comprises a spool 21 that is rotatably mounted relative to the housing 10. The spool 21 is downstream of the dispensing opening 11 on the path of the strip.

The second longitudinal end of the carrier strip 30 that is not fixed to the reel is fixed to the spool 21, and a part 33 of the strip, from which the units of eyelashes have been removed, is wound around the spool.

In a similar manner to the reel 20, the spool 21 is in the shape of a cylinder having a circular cross section, the cylinder being movable in rotation about its axis of revolution and having a length that is greater than or equal to the width of the carrier strip 30. This allows the carrier strip 30 to rest satisfactorily on the outer surface of the spool 21.

The spool 21 may be made of the same material as the housing 10.

The reel 20 and/or the spool 21 may comprise lateral flanges allowing said strip 30 to be guided.

An intermediate part 32 of the carrier strip 30, located between the part 31 wound around the reel 20 and the part 33 wound around the spool 21, passes close to the dispensing opening 11.

This part 32 is supported on a deflecting element 24, which is in this case in the form of an end of a rib 25 for guiding said strip 30. This deflecting element 24 is arranged close to the dispensing opening 11, that is to say at a distance from the dispensing opening that is less than the width of the units 40 of eyelashes.

The carrier strip 30 is tensioned by the deflecting element, and passes around it while changing direction, in its path between the reel 20 and the spool 21.

Moreover, in order to make it easier to handle the unit 40 of eyelashes for the purposes of applying adhesive thereto and of applying them, the edges of the dispensing opening 11 made in the housing 10 are preferably in the form of tweezers, as will be developed in the following.

Furthermore, the position of the reel 20 relative to the dispensing opening 11 may, in a non-limiting manner, be defined such that the length of the carrier strip 30 between the reel 20 and the dispensing opening 11 has a sufficient quantity of units of eyelashes 40 to cover one eye or both eyes, so that the units of eyelashes 40 applied to the same eye or both eyes have an identical curvature.

By way of non-limiting example, the following parameters are taken into consideration:

on the carrier strip 30, there is a spacing of 5 mm between two consecutive units of eyelashes 40, the units of eyelashes 40 have a width I of 5 mm, such that three units of artificial eyelashes are required to cover one eyelid, the eyelashes have a length L equal to 10 mm.

In operation, the part of the carrier strip 30 located downstream of the deflecting element 24 no longer holds any units of eyelashes because they have been removed through the dispensing opening. This part of the carrier strip is conveyed as far as the spool 33.

In this case, the mechanism for moving the carrier strip 30 further comprises actuating means 23 for rotating the spool 21, allowing the carrier strip 30 to be wound around the spool 21, winding the carrier strip 30 around the spool 21 causing the carrier strip 30 to move in order to dispense the eyelashes 41, as already mentioned.

Advantageously, the housing 10 comprises an opening 12 and the actuating means 23 comprises a scroll wheel 23 which can be operated via the opening 12.

The scroll wheel 23 may comprise a knurled wheel which projects out of the housing 10 through the opening 12. The spool 21 is, for example, coaxial with and rigidly connected to said scroll wheel 23. In this way, the strip 30 can be moved forwards by rotating the scroll wheel.

More specifically, the rotation of the scroll wheel 23 causes the spool 21 to rotate and the carrier strip 30 to be wound around the spool. This winding causes the part of the carrier strip 30 extending between the reel 20 and the spool 21 to be moved, and therefore causes the units of eyelashes 40 to be conveyed towards the dispensing opening, accompanied by the removal of the eyelashes in the region of the above-described dispensing opening. This movement causes the carrier strip to be unwound from the reel 20.

A mechanism for blocking the scroll wheel 23 in one direction of rotation can also be provided such that the user cannot rotate said wheel in the direction in which the spool 21 unwinds.

On this point, as shown in FIG. 4, in which the strip 30 is not shown, the device according to the invention may comprise a plate 102 which can be removed from the housing 10, said plate 102 being designed to prevent the strip 30 from being moved in the opposite direction to that of the movement of the strip which allows the eyelashes to exit.

Said plate 102 is arranged inside the housing. It is positioned relative to said housing for example by means of one or more pins 104, which are rigidly connected to the housing 10, for example which are integral therewith, and cooperate with openings 107 and/or receiving portions 109 in said plate 102.

Said device may further comprise a rotatable bearing 106 for guiding the strip. Said bearing 106 can rotate freely, for example about an integral finger, which is for example moulded, on said plate 102. Said finger on the plate 102 may itself be hollow in order to define one of the receiving portions 109 that cooperate with one of the positioning pins 104.

In this case, said plate has a central region 110 equipped with said positioning opening 107. From this central region 110, a flexible arm 112 projects laterally and acts as an anti-reverse lever by cooperating with a toothed wheel 114 which is coaxial with and rigidly connected to the spool 21, thereby allowing the plate to fulfil the above-mentioned function of blocking the movement of the strip 30 in an undesired direction.

As already stated, walls 120, 122 of the housing which are located on either side of the dispensing opening 11 may be designed to press against each other in the manner of tweezers, in order to hold one or more of said eyelashes 41 between said walls 120, 122.

According to an aspect of the invention, one 120 of said walls is fixed and the other 122, referred to as the movable arm of the tweezers, is articulated, in particular by pivoting about a shaft 125 relative to the remainder of the housing 10. In other words, in order to block the eyelashes 41, the user actuates the movable arm 122 to catch the eyelashes against the fixed wall 120. Said movable arm 122 may comprise, at its distal end, a lip 123 which allows planar contact against the fixed wall 120 so as to improve handling of the eyelashes 41.

In order to allow the movable arm 122 to be articulated, the device comprises, for example, an articulation shaft that is rigidly connected to the housing. In this case, said articulation shaft comprises one of the pins 104 also used to position said plate 102. For its part, said movable arm 122 comprises bearings 124 that are intended to cooperate with said articulation shaft of the housing.

Said device may further comprise a leaf spring 126 that exerts force on the movable arm 122 to hold it in an open position of the tweezers. Said leaf spring 126 exerts its effect for example on a part of the movable arm 122 that is between its rotary shaft 125 and its distal end 123.

In this case, said leaf spring is located on said plate 102. It comes in particular from one of the receiving portions 109 in said plate 102 that cooperate with one of the positioning fingers 104 of the housing 10.

Said movable arm 122 may further be designed to be held in a latched manner on the housing 10 in a closed position of said tweezers. In this case, said movable arm 122 comprises one or more flexible tabs 130 for this purpose that are intended to cooperate with a complementary shape 132 that is rigidly connected to the housing 10. Said flexible tabs are located at one end of the movable arm 122 opposite the end on which said leaf spring acts. In order to release the tweezers to allow them to return to an open position, the user presses on the movable arm 122 on the part thereof located between said articulation shaft 125 and said flexible tabs 130.

Said housing 10 may comprise a stop 170 for positioning said flexible tabs 130 in the open position of the tweezers. Said positioning stop may comprise a part, in particular an end of the guide rib 25 that is opposite the end located adjacent to the dispensing opening 11.

Said spool 21 may be located in the housing 10 at the end of the part of said movable arm 122 that is between its rotary shaft 125 and the end opposite the distal end 123, that is to say, in this case, the end comprising the flexible latching tabs 130.

Said movable arm 122 may further comprise a handling protrusion 134 for moving from the open position to the closed position. In this case, the protrusion is located between the rotary shaft 125 of said movable arm and its distal end 123, in particular between said rotary shaft 125 of said movable arm and an actuating region of said leaf spring 126.

In other words, the edges of the dispensing opening 11 form tweezers together with the walls 120, 122 of the housing, allowing said eyelashes to be gripped and removed from the carrier. Said tweezers are further designed to allow the eyelashes 41 to be held after removal in this case.

This can be seen in particular in FIG. 5*a*, in which the tweezers are open and the unit 40 of eyelashes 40 shown is still in position on the strip 30, and in FIG. 5*b*, in which the tweezers are closed and are holding one of said units 40 of eyelashes after they have been removed from the strip 30. In this way, adhesive can be applied to the fringe 42 of the eyelashes and said unit of eyelashes can then be applied to the user's eyelids.

The device according to the invention is configured in particular to allow the strip 30 to be moved when the tweezers are open.

One or more devices 1 may further be sold as part of a complete kit for applying artificial eyelashes, the kit further comprising a bottle of adhesive for applying adhesive to the connecting strip of the units of eyelashes, and a bottle of dissolving solution for dissolving said adhesive.

The invention claimed is:

1. Device for dispensing artificial eyelashes, comprising a housing equipped with a dispensing region, a carrier to which a plurality of artificial eyelashes is fixed, and a movement mechanism capable of being actuated to cause movement of the carrier in order to convey the artificial eyelashes towards the dispensing region and to allow the artificial eyelashes to exit through said dispensing region, each artificial eyelash comprising a unit of eyelashes interconnected at one end by a connecting strip; said connecting strip positioned to the side beyond said carrier, said eyelashes being oriented transversely to an axis of extension of the carrier, at least when they are passing through said dispensing region, wherein the eyelashes of one of said units of eyelashes are oriented in the opposite direction to the preceding and/or subsequent unit of eyelashes along the carrier.

2. Device according to claim 1, wherein said eyelashes are curved so as to be able to fit closely to the curvature of natural eyelashes, each artificial eyelash being positioned on said carrier in the region of the middle of the eyelashes in the longitudinal direction thereof.

3. Device according to claim 1, wherein the carrier comprises a strip, said eyelashes being positioned on said strip.

4. Device according to claim 3, wherein said strip comprises an adhesive region or a plurality of separate adhesive regions.

5. Device according to claim 4, wherein each of said adhesive regions is an adhesive strip positioned along the carrier.

6. Device according to claim 5, wherein said adhesive strip, of which one is provided, is located substantially along a central axis of said strip.

7. Device according to claim 5, wherein said adhesive strips, of which two are provided, are located along two longitudinal edges of said strip.

8. Device according to claim 1, wherein the movement mechanism comprises a reel that is rotatably mounted relative to the housing, said carrier being wound around said reel so as to be gradually unwound by the eyelashes exiting, said reel having a winding surface which is intended for receiving said eyelashes, said winding surface being provided with a curvature that is substantially identical to the curvature of the eyelashes.

9. Device according to claim 1, wherein the dispensing region comprises a dispensing opening located on a side of the housing.

10. Device according to claim 9, wherein said dispensing opening extends in parallel with said carrier.

11. Device according to claim 1, wherein the edges of the dispensing opening form tweezers together with the walls of the housing, allowing said eyelashes to be gripped and removed from the carrier.

12. Assembly for applying artificial eyelashes, comprising:

at least one device according to claim 1, a bottle of an adhesive capable of applying adhesive to units of eyelashes, and a bottle of a product capable of dissolving said adhesive.

* * * * *